US011903483B1

(12) United States Patent
Chen

(10) Patent No.: US 11,903,483 B1
(45) **Date of Patent: *Feb. 20, 2024**

(54) FOLDABLE STORAGE DEVICE

(71) Applicant: PROTREND CO., LTD., Taipei (TW)

(72) Inventor: Henry Chen, Taipei (TW)

(73) Assignee: PROTREND CO., LTD., Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/889,418

(22) Filed: Aug. 17, 2022

(51) Int. Cl.
*A47B 88/90* (2017.01)
*A47B 87/00* (2006.01)

(52) U.S. Cl.
CPC ..... *A47B 88/9414* (2017.01); *A47B 87/008* (2013.01)

(58) Field of Classification Search
CPC ..... A47B 88/9414; A47B 87/008
USPC ..... 312/258, 330.1
See application file for complete search history.

(56) References Cited

U.S. PATENT DOCUMENTS 5,938,059 A * 8/1999 Luburic ..... B65D 11/1833 220/6
6,193,340 B1 * 2/2001 Schenker ..... A47B 47/0075 312/265.5
6,619,769 B1 * 9/2003 Hammonds ..... A47B 88/994 312/330.1
7,549,550 B2 * 6/2009 Smyers ..... B65D 11/1833 220/691
10,118,728 B2 * 11/2018 Yamamoto ..... B65D 21/0213
D850,106 S * 6/2019 Yamamoto ..... D3/297
11,259,634 B1 * 3/2022 Chen ..... A47B 57/12
11,459,145 B2 * 10/2022 Su ..... B65D 21/0226
2009/0145897 A1 * 6/2009 Chen ..... B65D 11/1806 220/4.28
2011/0221318 A1 * 9/2011 Chen ..... A47B 88/941 312/263
2016/0272364 A1 * 9/2016 Jian ..... B65D 19/18

* cited by examiner

*Primary Examiner* — Daniel J Troy
*Assistant Examiner* — Timothy M Ayres
(74) *Attorney, Agent, or Firm* — WPAT, P.C

(57) ABSTRACT

This invention discloses a storage device which consists of one drawer and one shell. The shell consists of one top panel and two side panels. Each side of the top panel offers a downward protruding wall. There are at least two downward-protruding, front-to-back-extending positioning plates located on the bottom edges of the two protruding walls of the top panels of the shell. The top ends of the two side panels are pivotally connected to the protruding walls on the corresponding sides of the top panels. Each of the positions at which the top sides of the two side panels connect to the positioning plates has a front-to-back-extending long groove. When in the standing form, the two side panels can slide backwards against the top panel, allowing each positioning plate to slide into their corresponding long grooves.

7 Claims, 13 Drawing Sheets

FOLDABLE STORAGE DEVICE

FIELD OF INVENTION

This invention discloses a foldable storage device which consists of one drawer and one shell. The drawer and the shell are both foldable, expanded when in use or folded flat when not in use for easy storage.

PRIOR ART

A plastic drawer storage device commonly seen on the market mainly consists of a shell and a drawer. The drawer can be installed inside the shell and pulled out to reveal the storage area. The drawer can be pushed inwards to hide the storage area. Both the shell and the drawer are made in fixed shapes, hence the larger volumes. There are also some multi-layer drawer storage devices on the market. Such devices are even larger in volumes, taking up even more space when not in use. They bring inconvenience to storage and logistics. They also increase shipping costs.

Another common type is a storage device consisting of one drawer and one shell. It uses a folding mechanism. The shell is assembled for use. Such device is shipped to consumers in a flat form. The components of the shell are also stacked flat in order to minimize the total volume. This helps with logistics and shipping. After the purchase, the shell is then assembled into a standing form by the consumer. All of the panels of the drawer are then expanded into the standing form. It can be difficult to disassemble the shell after it is assembled. Therefore, when the consumer needs to stow or move this device because of personal reasons, say moving home, the difficulties in disassembling the shell can bring inconvenience to storage and shipping.

U.S. Pat. No. 11,259,634 discloses a foldable storage device which consists of one shell and one drawer. The drawer and the shell are both foldable, taking up little space in storage, logistics and shipping. However, when the shell is expanded, the side panels offer lower rigidity when in the standing form.

SUMMARY OF THE INVENTION

This invention discloses a storage device which consists of one drawer and one shell. Both the drawer and the shell are foldable. The shell offers great rigidity when in standing form.

This invention discloses a foldable storage device which consists of one foldable drawer and one foldable shell. The drawer can be folded into a flat form, or expanded into a box form. The shell can be expanded into a standing form, or folded into a flat form.

The shell consists of one top panel and two side panels. Each side of the top panel offers a downward protruding wall. The top ends of the two side panels are pivotally connected to the protruding walls on the corresponding sides of the top panels. The two side panels can each rotate into either a standing form or lying form with the pivot of the pivot connection as an axis. The drawer can be inserted in between the side panels in order to hide into the shell. There are at least two downward-protruding, front-to-back-extending positioning plates located on the bottom edges of the two protruding walls of the top panels of the shell. Each of the positions at which the top sides of the two side panels connect to the positioning plates has a front-to-back-extending long groove. There is an opening at the rear of the long groove. When in the standing form, the two side panels can slide backwards against the top panel, allowing each positioning plate to slide into their corresponding long grooves.

The rear edge of the top panel of the shell offers a downward-protruding stopping plate. The left and right ends of the stopping plates each has a protruding bar. There is one flexible hook inside the rear end of the side panel. The flexible hooks on the two side panels each hooks the protruding bars on the left and right extending plates of the stopping plate. The two side panels are then locked into place.

There is an opening on the rear end of each of the long grooves of the two side panels of the shell. The opening is connected to a cutout. The positioning plates can be inserted into the cutouts and aligned with the openings of the long grooves.

There is a head at the top end of each of the positioning plates. The width of the head is larger than that of the long groove of the side panel. There are at least two covering plates on each of the side panels in order to cover up the corresponding long grooves and the positioning plates inserted into the long grooves.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DESCRIPTION OF PREFERRED EMBODIMENT

Figure 1:
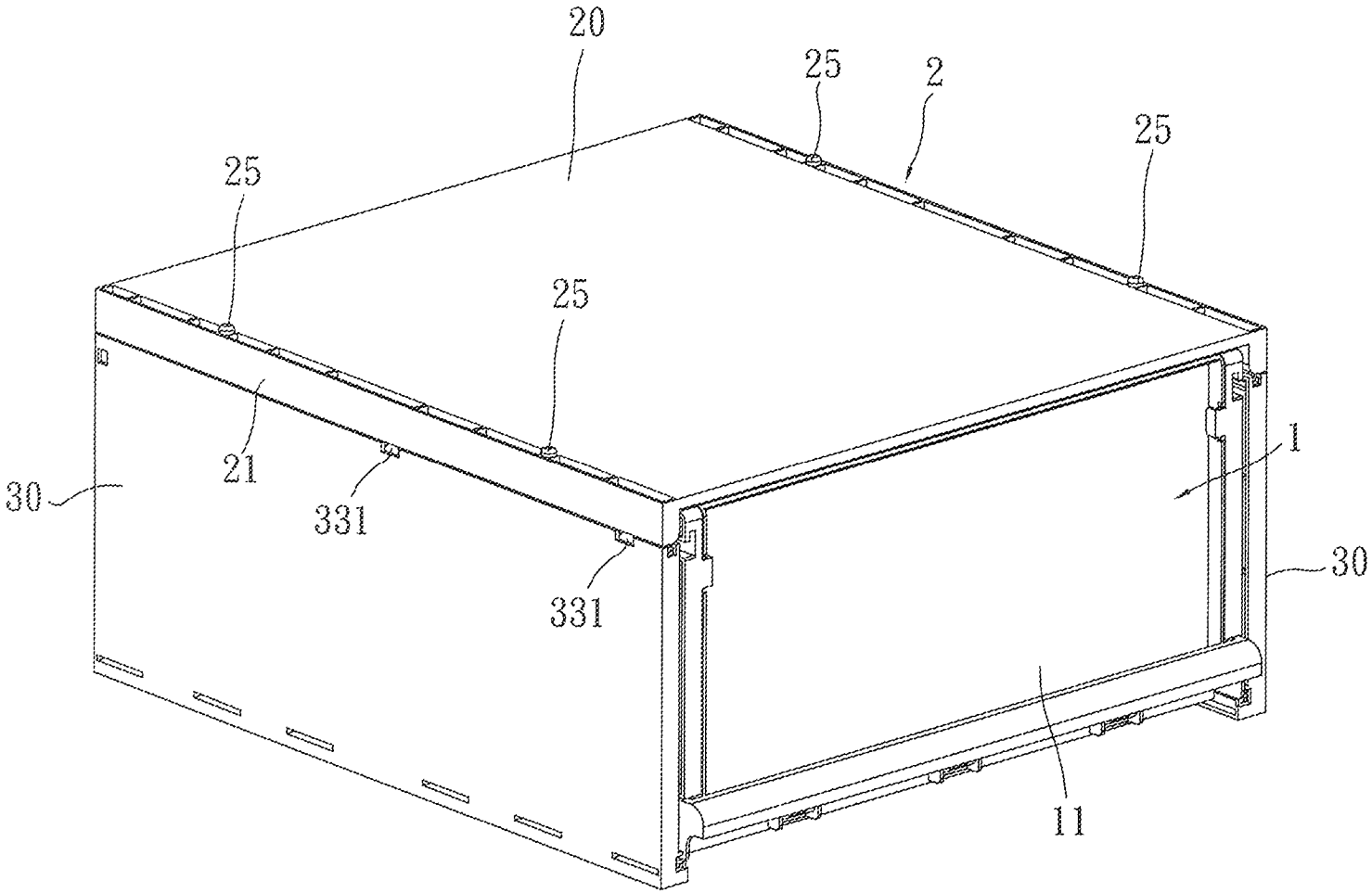
FIG. 1 is an exterior drawing of an embodiment of this invention.
Figure 2:
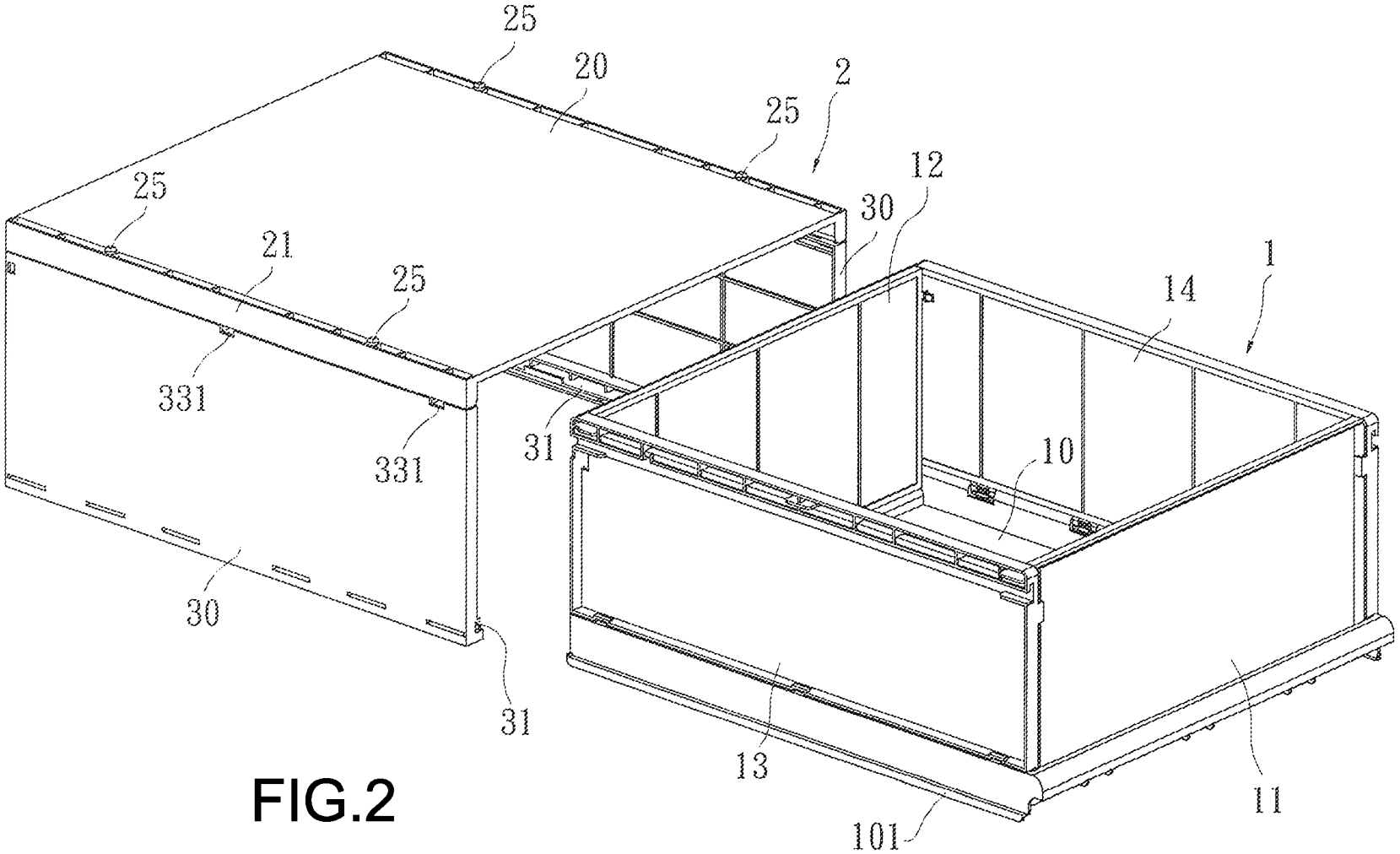
FIG. 2 is a breakdown drawing of the drawer and the shell.
Figure 3:
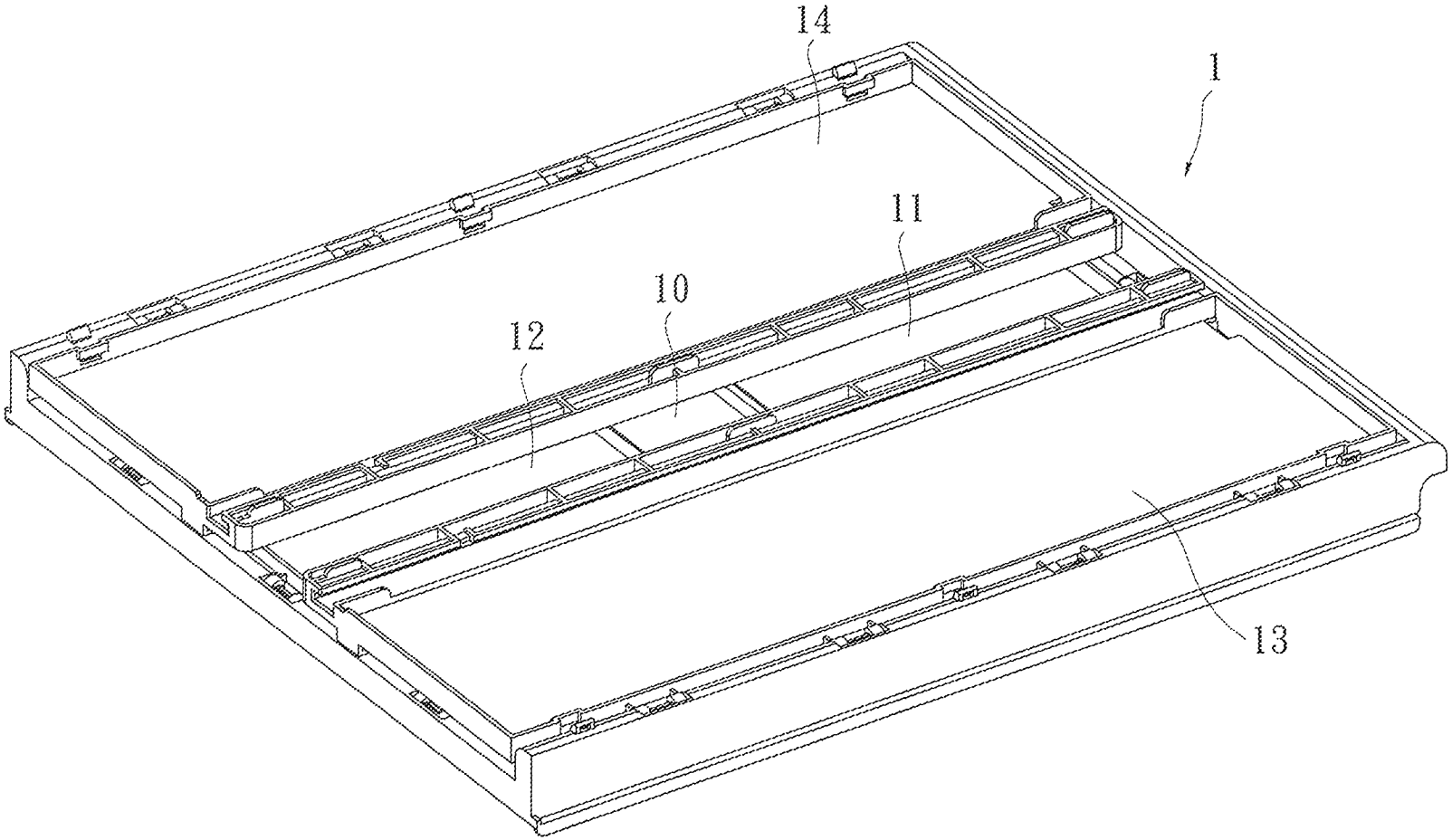
FIG. 3 is an exterior drawing of the drawer in its lying form.

See FIGS. 1 and 2. This invention discloses a foldable storage device which consists of one foldable drawer 1 and one foldable shell 2. The drawer 1 consists of one bottom panel 10, one front panel 11, one rear panel 12, one left panel 13, and one right panel 14. The lower ends of the front panel 11, rear panel 12, left panel 13, and right panel 14 are each pivotally connected to the front, rear, left, and right ends of the bottom panel 10. The front panel 11, rear panel 12, left panel 13, and right panel 14 can each be rotated with the pivots of the pivot connections as axes. Therefore, the drawer 1 can be folded into a flat form (see FIG. 3), or expanded into a box form (see FIG. 2). The foldable drawer 1 uses a known structure which is not a technical characteristic of this invention. Hence, no further description is provided.

See FIGS. 4 to 7. The shell 2 consists of one top panel 20 and two side panels 30. Each side of the top panel 20 offers a downward protruding wall 21. The top ends of the two side panels 30 are pivotally connected to the protruding walls 21 on the corresponding sides of the top panels 20. The two side panels 21 can each be rotated into either a standing form or lying form with the pivot 211 of the pivot connection as an axis. In other words, the shell 2 can be expanded into a standing form when in use (see FIG. 4). It can also be folded into a flat form (see FIG. 5) for easy storage. There is a guiding groove 31 on the inside of each of the side panels 30. The openings of the grooves face inwards and are. The two guiding grooves 31 extend front-to-back. The two protruding rails 101 of the two outer walls of the bottom panel 10 of the drawer can each be inserted into the two guiding grooves 31 of the insides of the two side panels of the shell 2. Therefore, the drawer 1 can be pushed into the shell 2, or pulled out of the shell 2.

Figure 4:
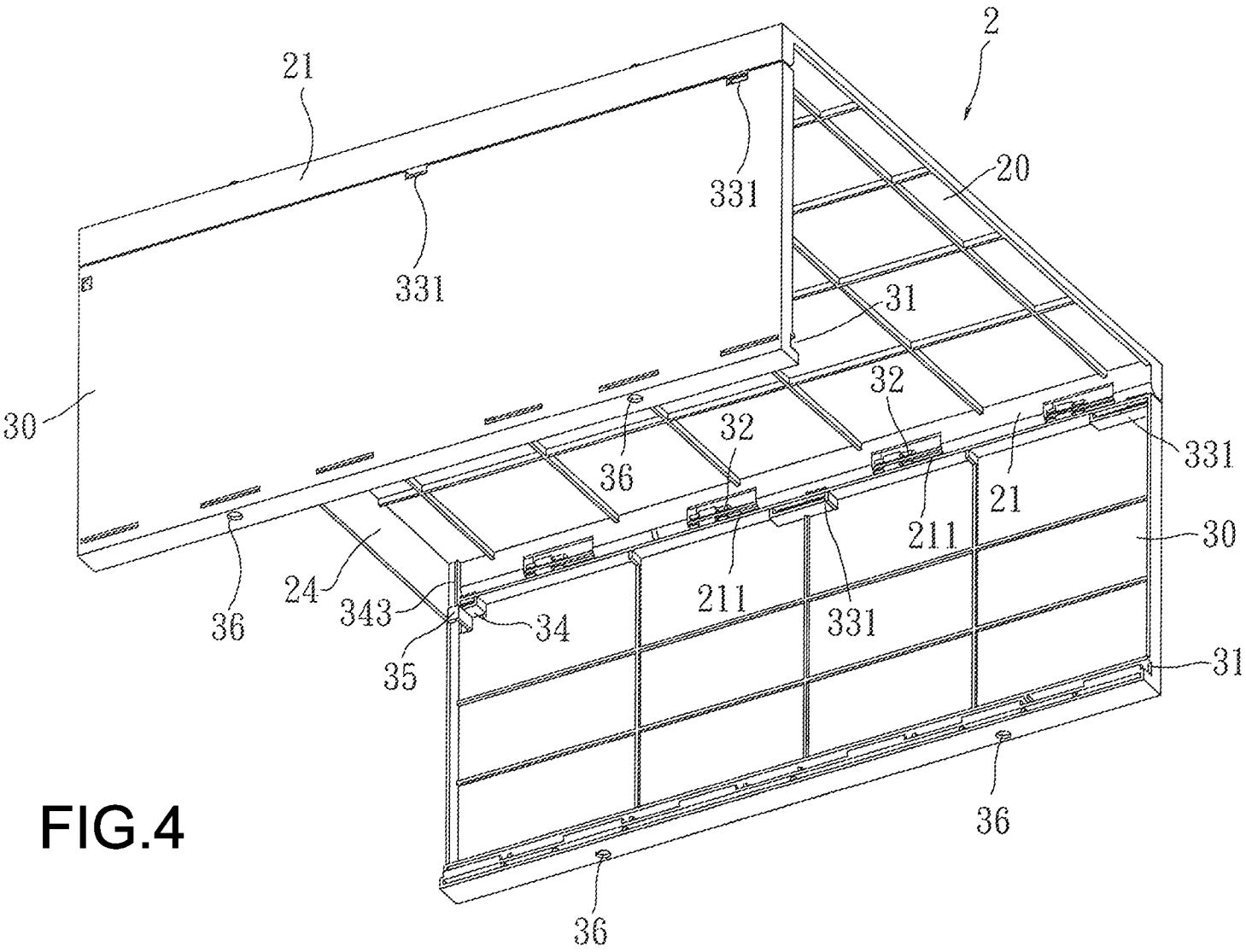
FIG. 4 is an exterior drawing of the shell in its standing form.

The pivot connection of the top end of the two side panels 30 of the shell 2 and the top panel 20 consist of at least two pivots 211 inside the two protruding walls 21 of the top plate 20, and at least two hooks 32 on the two side panels 30. In this example, the two protruding walls 21 each has four pivots 211. The two side panels 30 each has four hooks 32. With the hooks 32 of the two side panels 30 hooked on the corresponding pivots 211 of the top panel 20, the two side panels 30 can be rotated with the corresponding pivots 211 as axes. The pivot connection utilizing pivots 211 and hooks 32 is a common technique. In this invention, the pivots 211 is longer than the width of the hooks 32, allowing the hooks 32 to slide back and forth along the corresponding pivots 211. Therefore, the two side panels 30 can slide front and back against the top panel 20 when it is in the standing form (see FIG. 9), as shown in FIG. 4.

Figure 7:
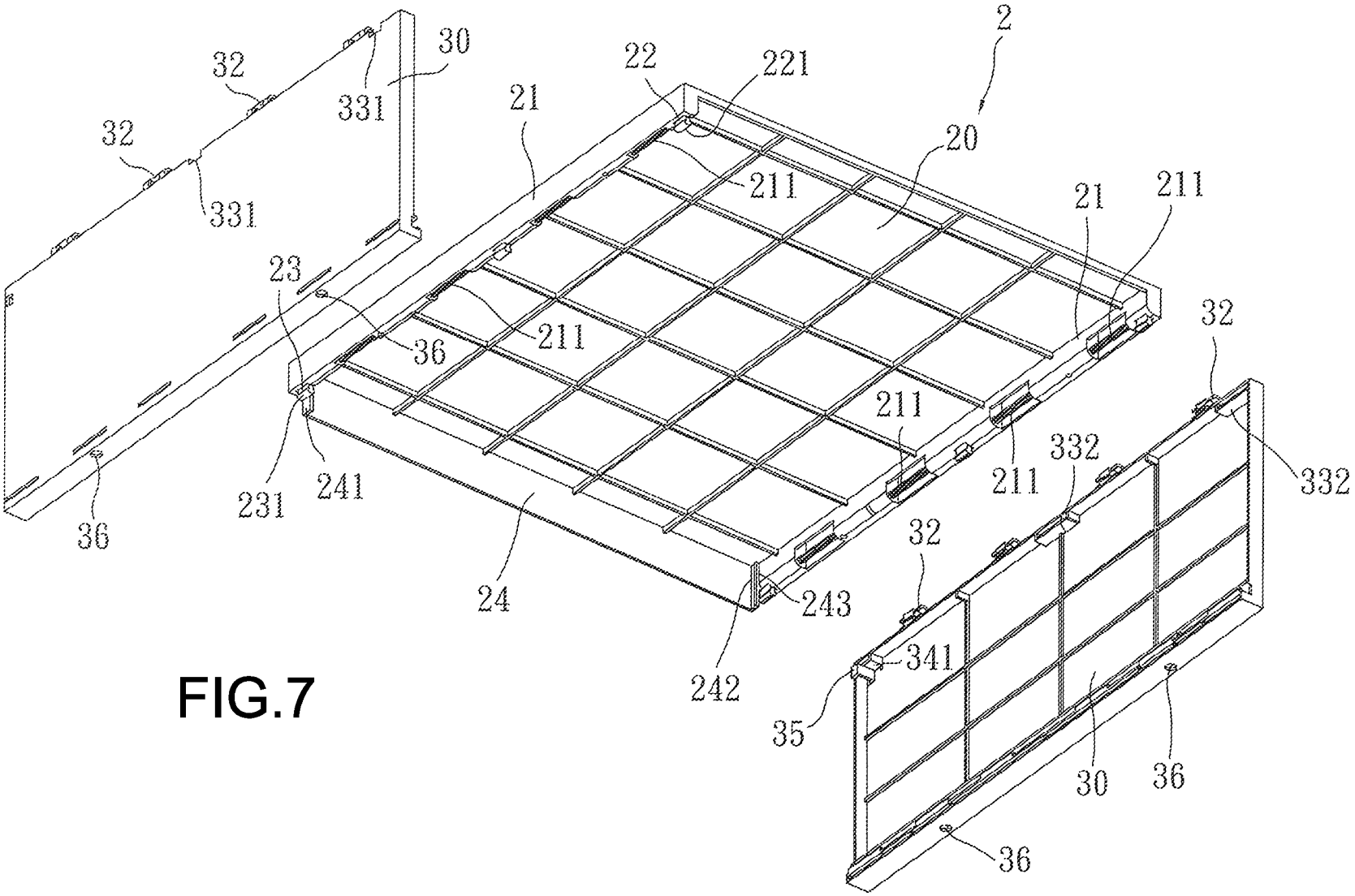
FIG. 7 is a breakdown drawing of the shell.
Figure 8:
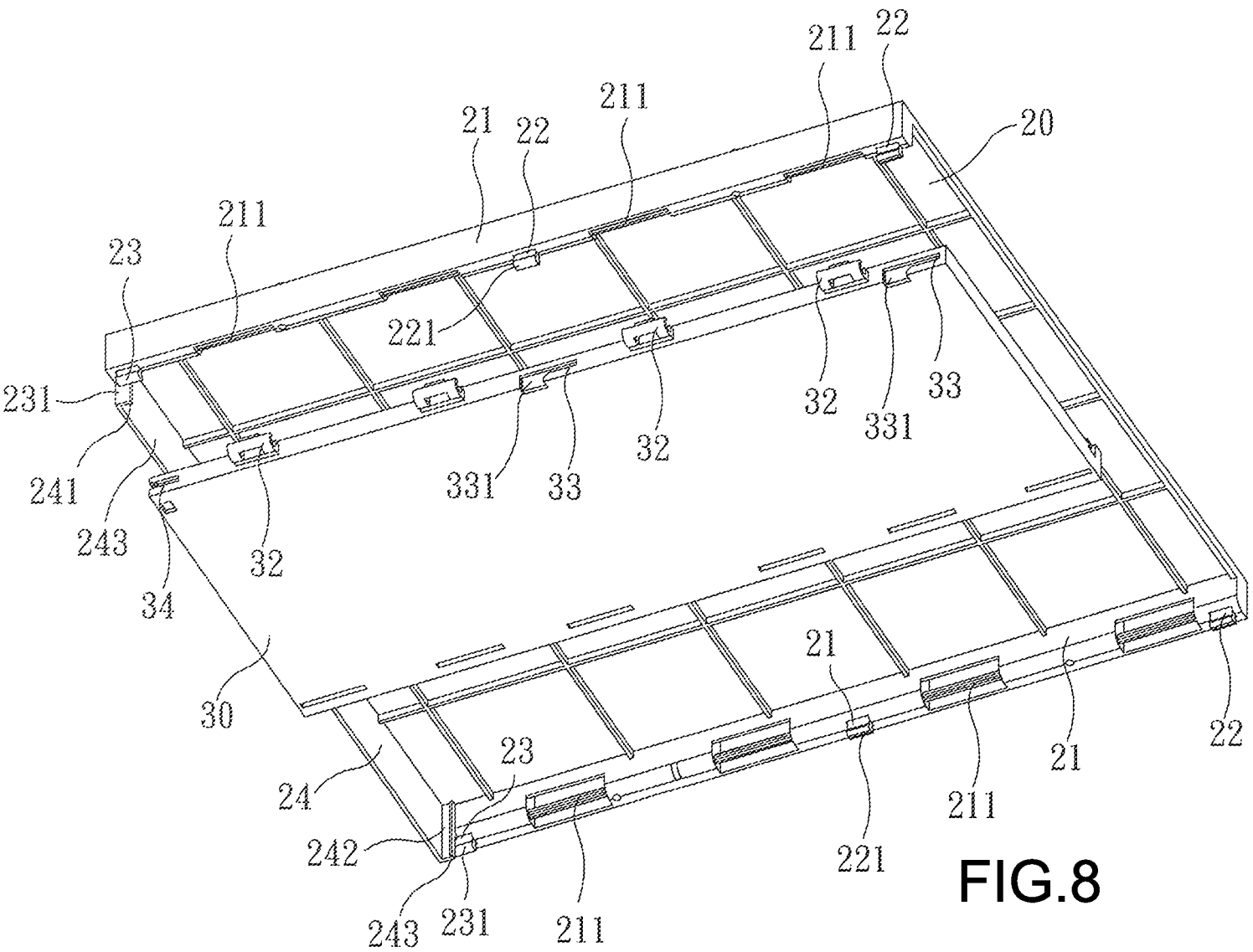
FIG. 8 is a breakdown drawing of the top and side panels of the shell.
Figure 9:
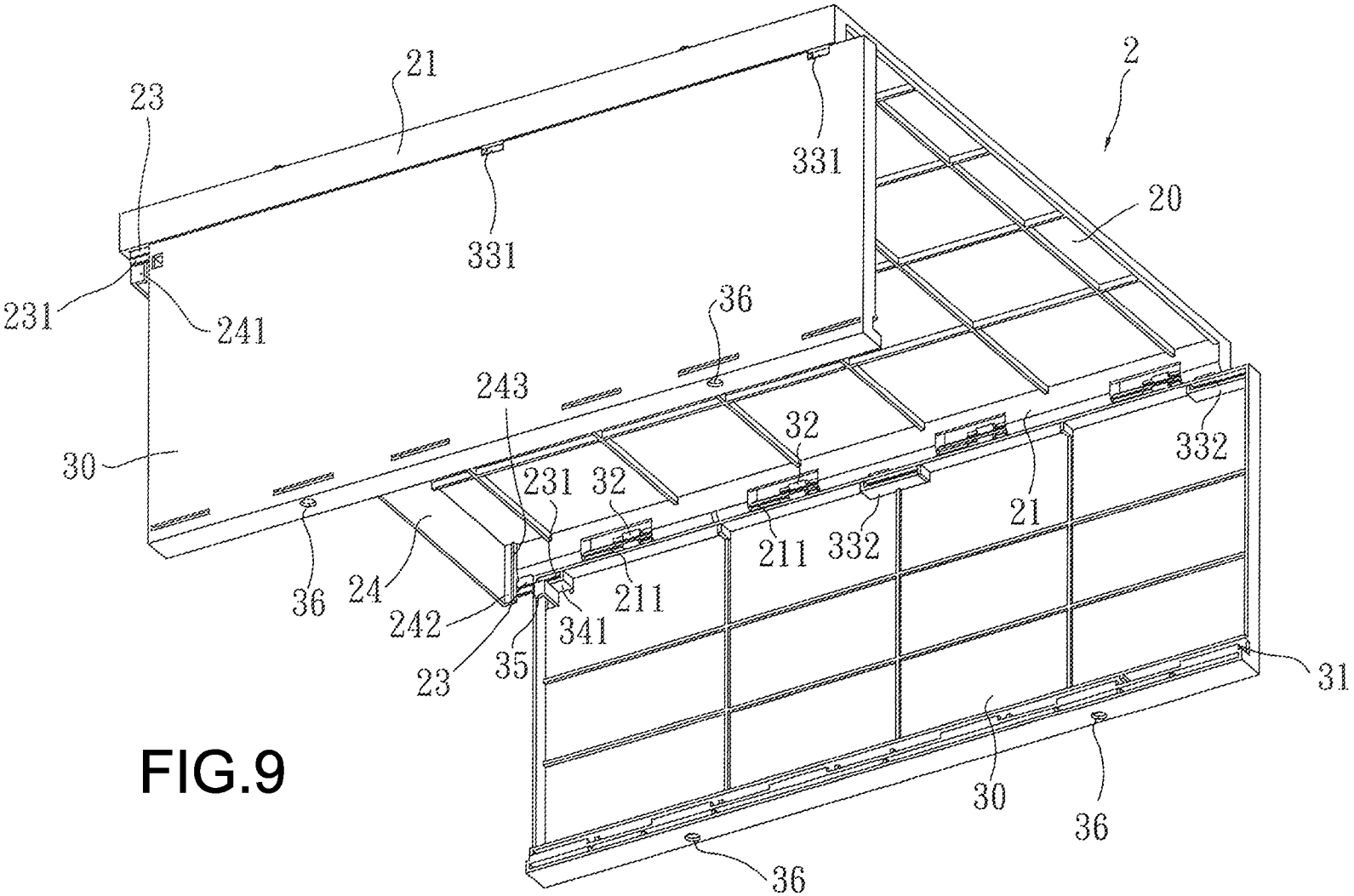
FIG. 9 is a state drawing of the two side panels of the shell rotated 90° outwards.

See FIGS. 7 and 8. There are at least two downward-protruding, front-to-back-extending positioning plates 22, 23 located on the bottom edges of the two protruding walls 21 of the top panels 20 of the shell 2. In this example, there are three positioning plates 22, 23 on each of the two protruding walls 21 in corresponding positions. The three positioning plates 22, 23 on the same protruding wall 21 are installed along the same line. Each of the positions at which the top sides of the two side panels 30 connect to the positioning plates 22, 23 has a front-to-back-extending long groove 33, 34. There is an opening at the rear of each of the long grooves 33, 34. When the two side panels 30 rotate outwards into the standing form with the pivots 211 as axes, the positioning plates 22, 23 will align with the openings of the corresponding long grooves 33, 34. The two side panels 30 can then slide backwards against the top panel 20, allowing each positioning plate 22, 23 to slide into their corresponding long grooves 33, 34. The two side panels 30 is then locked in the standing form. During the operation, the openings of the long grooves 33, 34 are in a flared form, allowing the positioning plates 22, 23 to be easily inserted into the long grooves 33, 34. There are heads 221, 231 at the top ends of the positioning plates 22, 23. The width of the heads 221, 231 is larger than that of the long grooves 33, 34 of the side panels 30. The inner edges of the bottom edges of the two protruding walls 21 of the top panel 20 are in a curved shape so they do not interfere with the outward rotation of the side panel 30, as shown in FIG. 9. When the side panels 30 are rotated to the standing form, the top sides of the side panels 30 are attached to the bottom sides of the protruding walls 21.

Figure 5:
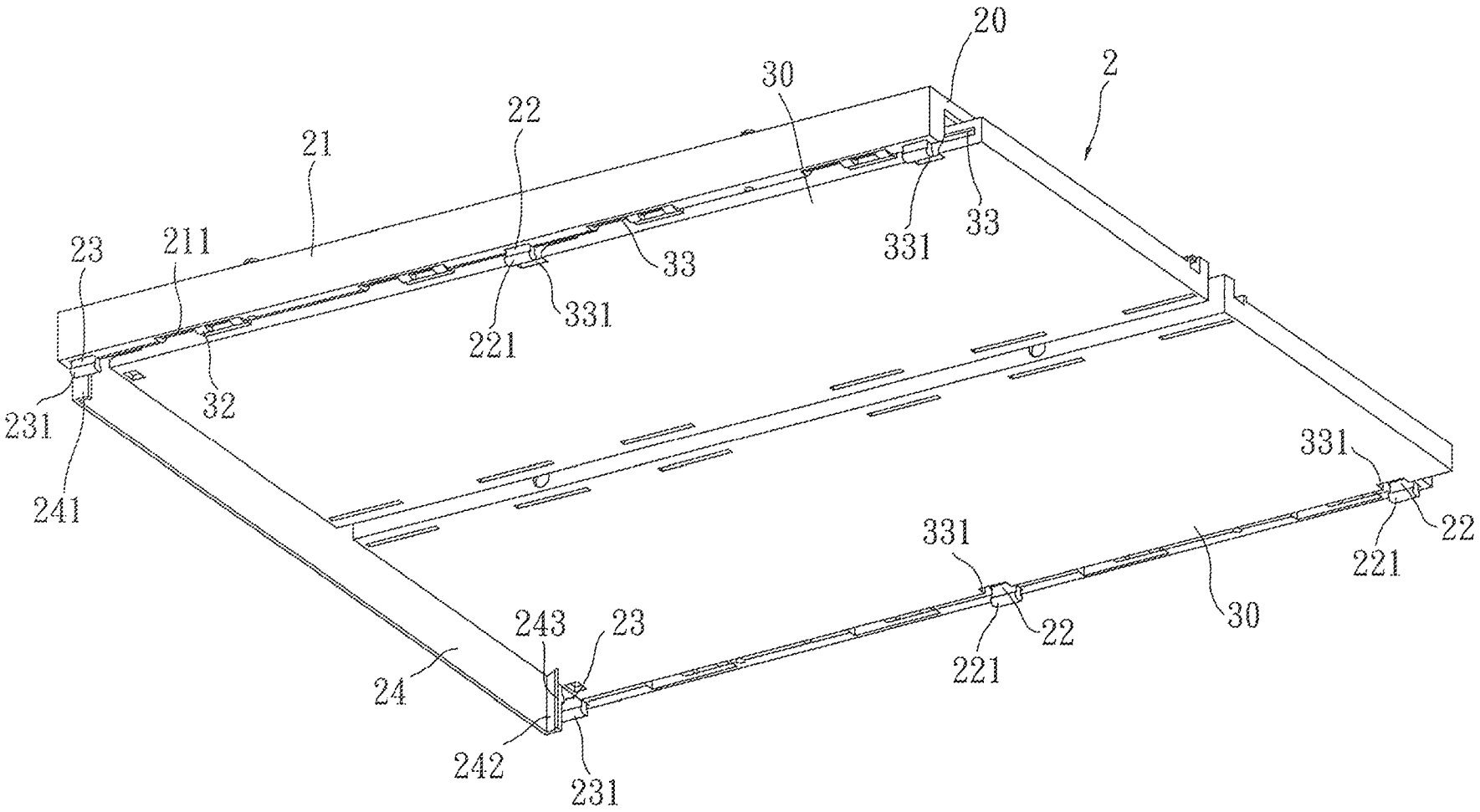
FIG. 5 is an exterior drawing of the shell in its lying form.
Figure 6:
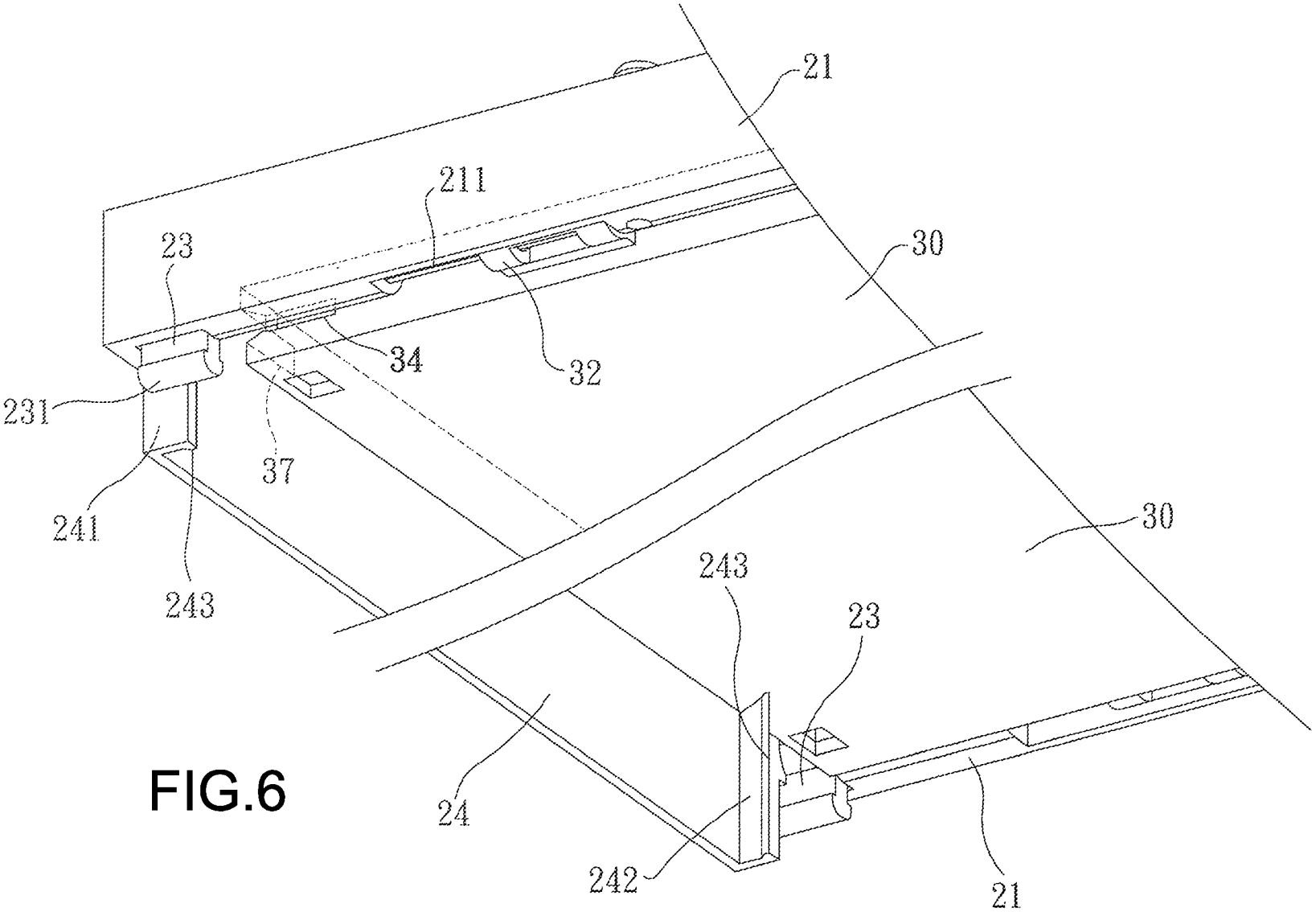
FIG. 6 is an enlarged local drawing of FIG. 5.
Figure 10:
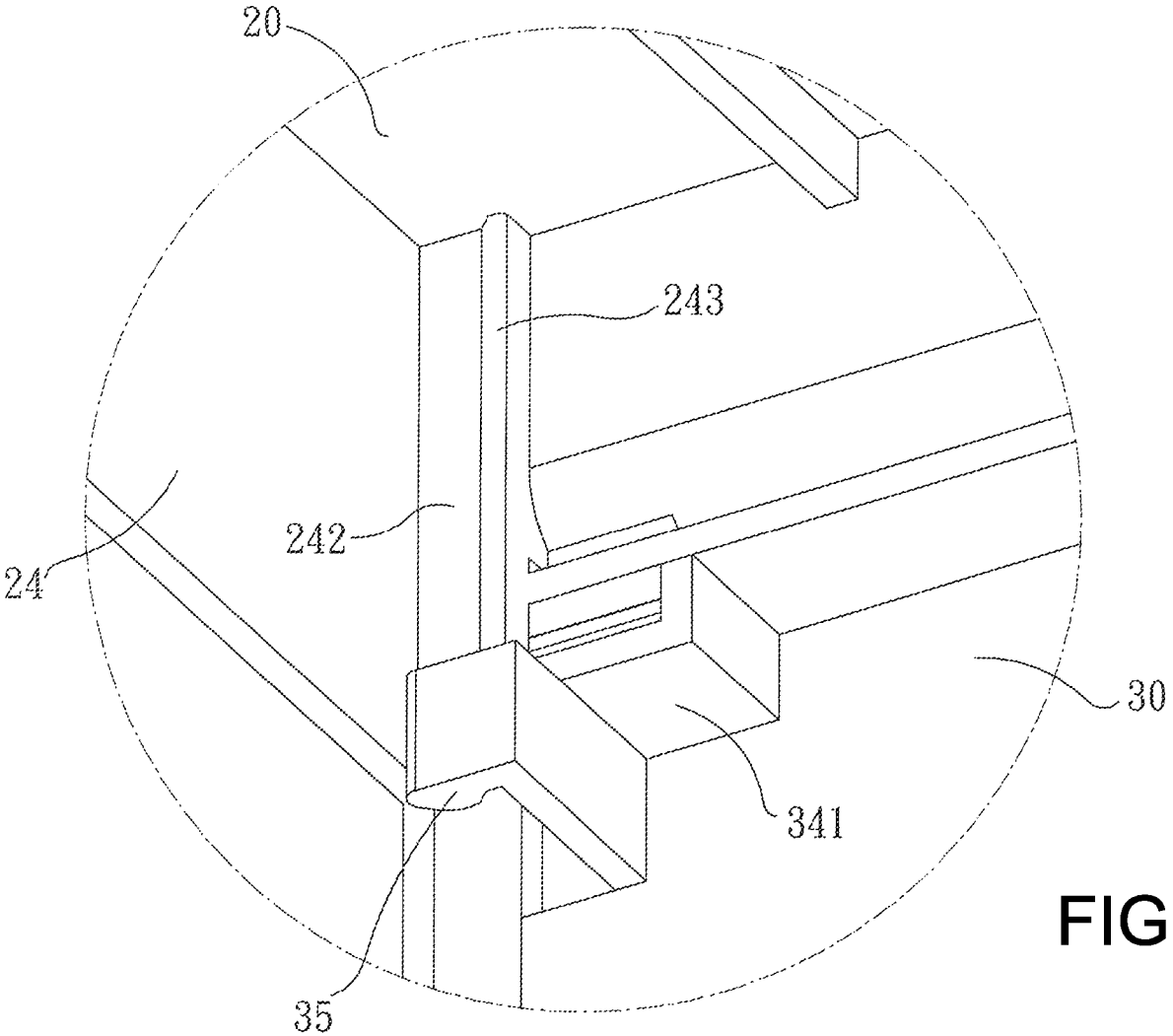
FIG. 10 is an enlarged state drawing of the flexible hooks of the side panels hooking the protruding bars of the stopping plates.

See FIGS. 5 and 6. The rear edge of the top panel 20 of the shell 2 offers a downward-protruding stopping plate 24. The bottom edge of the stopping plate 24 is lower than that of the two protruding walls 21. The left side of the stopping plate 24 has a forward-extending left extending section 241. The right side of the stopping plate 24 has a forward-extending right extending section 242. The front ends of the left extending section 241 and right extending section 242 each has an inward-protruding, vertical-extending bar 243. There are one flexible hook 35 inside the rear end of the side panel 30. When the two side panels 30 are moved back into position, each positioning plate 22,23 can slide into their corresponding long grooves 33, 34. This makes the two side panels 30 unable to rotate. See FIGS. 9 and 10. At the same time, the flexible hooks 35 on the two side panels 30 each hooks the protruding bars 243 on the left and right extending plates 241, 242 of the stopping plate 24. The two side panels 30 are then locked into place.

See FIG. 8. Each of the rear opening of the long grooves 33 of the two side panels 30 is connected to a cutout 331. When the two side panels 30 are moved to the front end against the top panel 20, the two side panels 30 can then be rotated outwards. In this state, all of the positioning plates 22 of the top panel 20 can be inserted to their corresponding cutouts 331 without interfering with the rotation of the two side panels 30. When the two side panels 30 are rotated into the standing form, the positioning plates 22 will align with the openings of the corresponding long grooves 33. The openings of the long grooves 34, located on the rear ends of the two side panels 30, are integrated into the rear ends of the two side panels 30. Therefore, the long grooves 34 on the rear ends are in open form. When the two side panels 30 are rotated outwards into the standing form, the positioning plates 23 at the rear ends of the two protruding walls 21 of the top panel 20 will align with the openings of the long grooves 34 on the rear ends of the two side panels 30. See FIG. 6. Each of the rear sides of the two side panels 30 is integrated with a through-hole 37 which allows the positioning plate 23 to go through.

When the side panels 30 are in the lying form, the hooks 32 move to the front-most positions of the axes 211. In this state, the side panels 30 can be rotated outwards into the standing form. From this position, the side panels 30 can be moved backwards, allowing the positioning plates 22, 23 to slide into their corresponding long grooves 33, 34. This makes the side panels 30 unable to fold. At the same time, the flexible hooks 35 on the two side panels 30 can hook onto the protruding bars 243 on the left and right extending plates 241, 242 of the stopping plate 24. The two side panels 30 are then locked into place. This prevents the side panel 30 from moving forward when in use.

Figure 11:
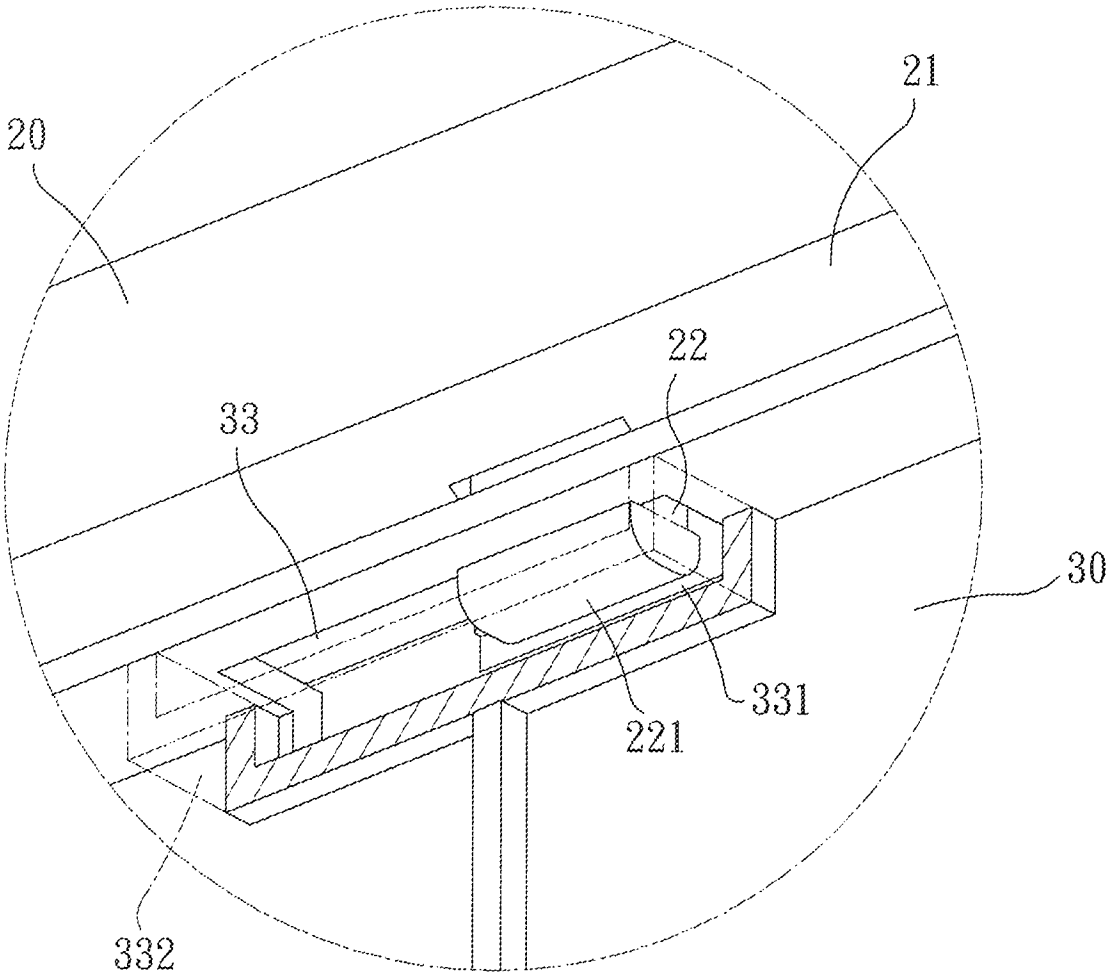
FIG. 11 is an enlarged local drawing of the cut plane of the covering plate.

See FIGS. 4 and 11. The structural rigidity of the points at which the long grooves 33, 34 and the cutouts 331 are located on the two side panels 30 is relatively lower. There are at least two covering plates 332, 341 on each of the two side panels in order to cover up the corresponding long grooves 33, 34 and the positioning plates 22, 23 inserted into the long grooves 33, 34. Both ends of the covering plates 332, 341 are connected to the bottom plate of the side plates 30 in order to strengthen the rigidity of the locations of the long grooves 33, 34 and the cutouts 331.

Figure 12:
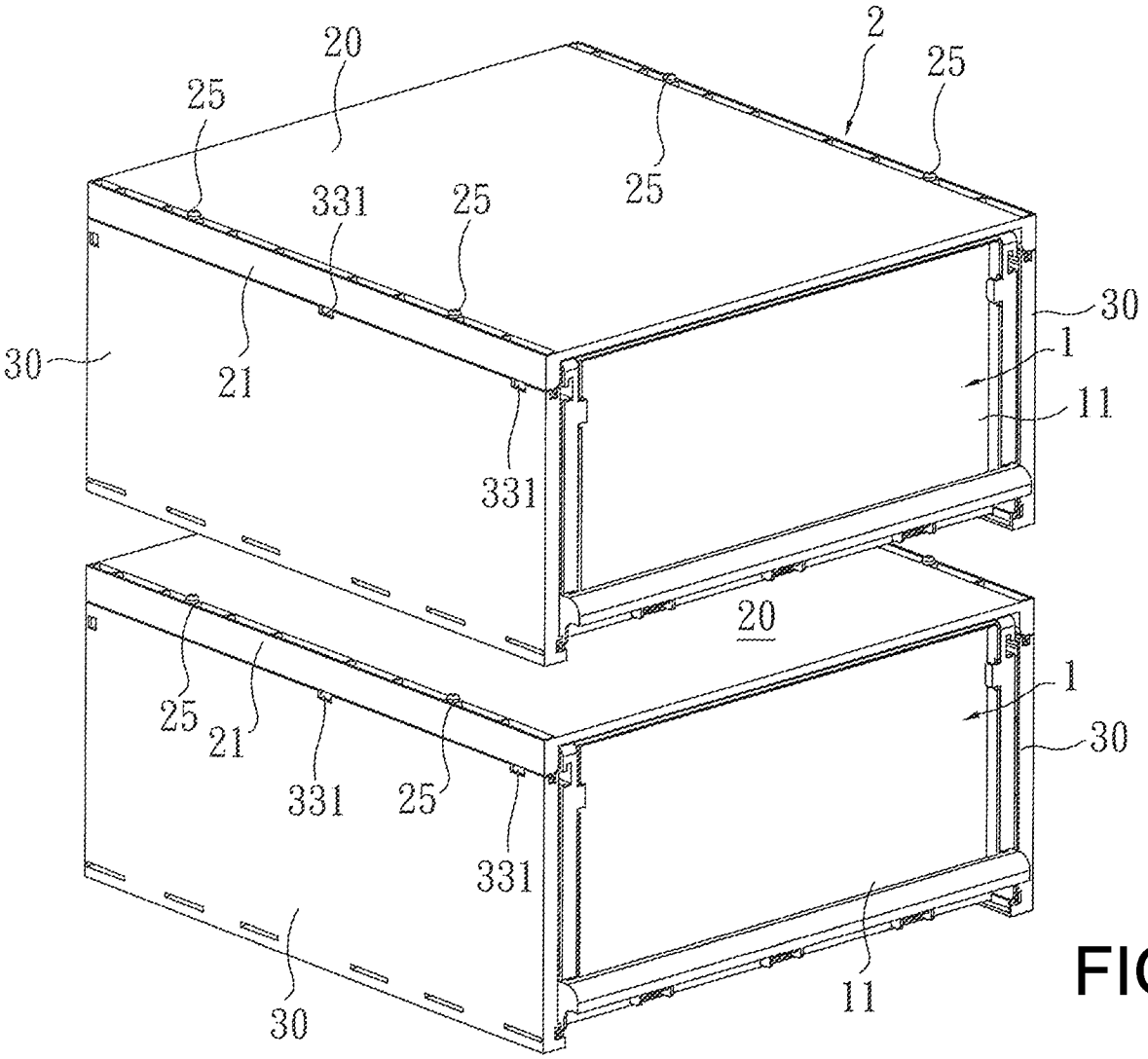
FIG. 12 is an operation drawing of how two storage devices are stacked on each other.
Figure 13:
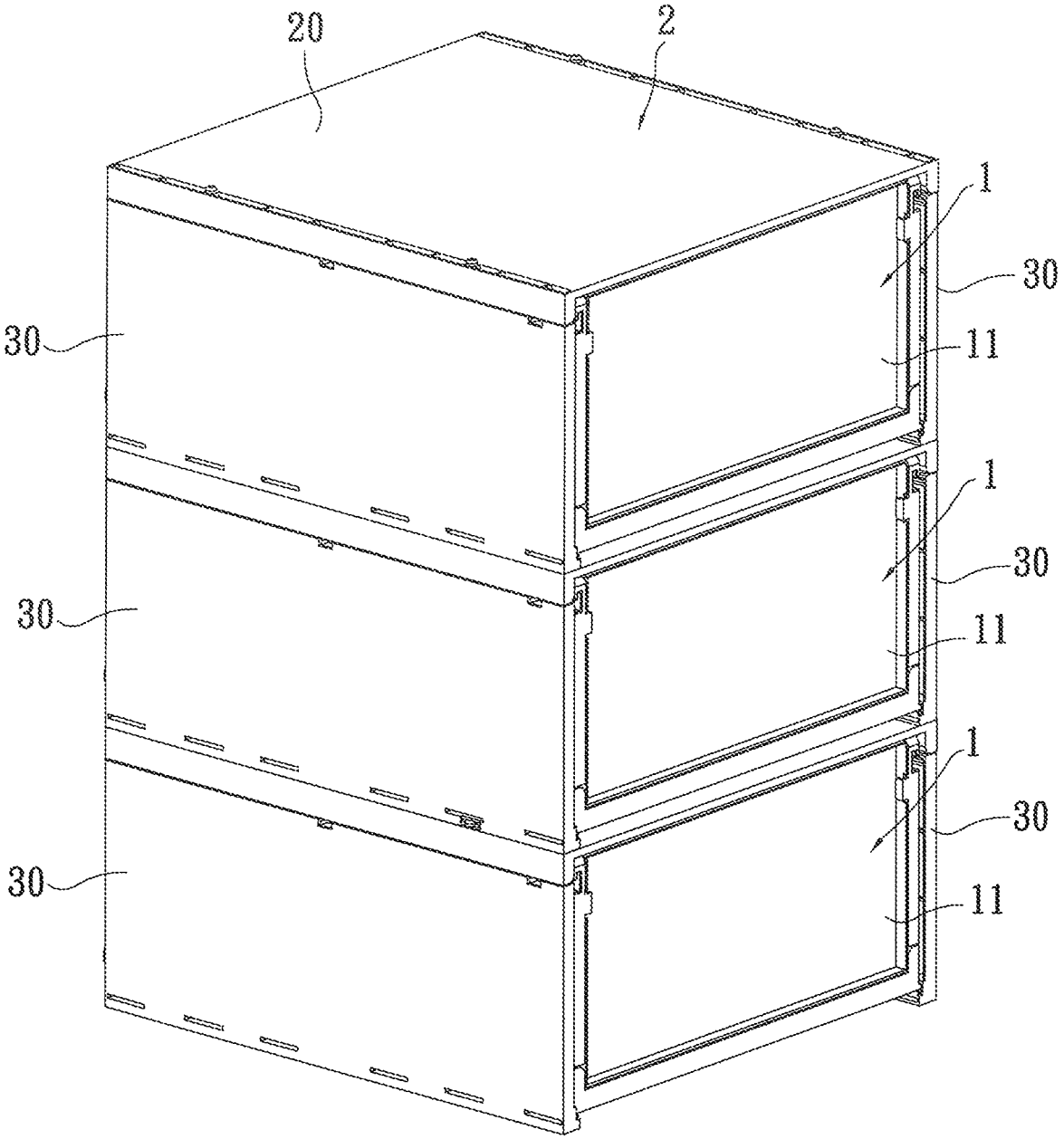
FIG. 13 is a state drawing of when three storage devices are stacked on one another.

The top end of the top panel 20 of the shell 2 has four upward-protruding bumps 25. The bottom side of the two side panels 30 each has two small slots 36. By inserting the four bumps 25 of the top panel 20 on one shell 2 into the four small slots 36 of the two side panels 30 of another shell 2, two or more shells 2 can be stacked on one another, as shown in FIGS. 12 and 13.

In conclusion, this invention discloses a storage device consisting of one drawer 1 and one shell 2. The device can be folded flat to significantly decrease the total volume, which helps with logistics and shipping. Furthermore, the shell 2 offers high structural rigidity when expanded for better user experience.

What is claimed is:

1. A foldable storage device, comprising:

one foldable drawer and one foldable shell;

wherein the foldable shell comprises one top panel and two side panels, each side of the top panel offers a downward protruding wall, the top ends of the two side panels are pivotally connected to the protruding walls on the corresponding sides of the top panel, the two side panels each rotates into either a standing form or lying form with the pivot of the pivot connection as an axis, and the drawer is inserted in between the side panels in order to hide into the shell;

wherein the top panel comprises at least two downward-protruding, front-to-back-extending positioning plates located on the bottom edges of the two protruding walls of the top panel;

wherein each of the two side panels has a front-to-back-extending long groove for connecting to the positioning plates, each long groove has an opening at a rear of each long groove the two side panels rotate outwards into the standing form for allowing the positioning plates to align with the openings of the corresponding long grooves, the two standing side panels slide backwards against the top panel for allowing each positioning plate to slide into their corresponding long grooves and locks the two side panels into the standing forms;

wherein the openings of the long grooves are connected to cutouts, and the positioning plates are inserted into the cutouts and aligned with the openings of the long grooves; and wherein the openings of the long grooves are integrated into rear ends of the two side panels, when the two side panels are rotated outwards into the standing form, the positioning plates at the rear ends of the two protruding walls of the top panel will align with the openings of the long grooves.

2. The foldable storage device, as claimed in claim 1, wherein the rear edge of the top panel of the shell offers a downward-protruding stopping plate; the bottom edge of the stopping plate is lower than that of the two protruding walls; the left side of the stopping plate has a forward-extending left extending section; the right side of the stopping plate has a forward-extending right extending section; the front ends of the left extending section and right extending section each has an inward-protruding, vertical-extending bar; there are one flexible hook inside the rear end of the side panel; the flexible hooks on the two side panels can hook onto the protruding bars on the left and right extending plates of the stopping plate; the two side panels are then locked into place.

3. The foldable storage device, as claimed in claim 1, wherein each of the rear sides of the two side panels is integrated with a through-hole which allows the positioning plate to go through.

4. The foldable storage device, as claimed in claim 1, wherein there is a head at each of the top ends of the positioning plates; and the width of the heads is larger than that of the long grooves of the side panels.

5. The foldable storage device, as claimed in claim 1, wherein there are at least two covering plates on the side panel in order to cover up the corresponding long grooves and the positioning plates inserted into the long grooves.

6. A foldable storage device, comprising:

one foldable drawer and one foldable shell;

wherein the foldable shell comprises one top panel and two side panels, each side of the top panel offers a downward protruding wall, the top ends of the two side panels are pivotally connected to the protruding walls on the corresponding sides of the top panel, the two side panels each rotates into either a standing form or lying form with the pivot of the pivot connection as an axis, and the drawer is inserted in between the side panels in order to hide into the shell;

wherein the top panel comprises at least two downward-protruding, front-to-back-extending positioning plates located on the bottom edges of the two protruding walls of the top panel;

wherein each of the two side panels has a front-to-back-extending long groove for connecting to the positioning plates, each long groove has an opening at a rear of each long groove, the two side panels rotate outwards into the standing form for allowing the positioning plates to align with the openings of the corresponding long grooves, the two standing side panels slide backwards against the top panel for allowing each positioning plate to slide into their corresponding long grooves and locks the two side panels into the standing forms; and wherein the pivot connection of the top end of the two side panels of the shell and the top panel include at least two pivots inside the two protruding walls of the top plate and at least two hooks on the two side panels; the two side panels rotate with the corresponding pivots as axes as the hooks of the two side panels hooked on the corresponding pivots of the top panel, and the pivots are longer than the width of the hooks for allowing the hooks to slide back and forth along the corresponding pivots.

7. A foldable storage device, comprising:

one foldable drawer and one foldable shell;

wherein the foldable shell comprises one top panel and two side panels, each side of the top panel offers a downward protruding wall, the top ends of the two side panels are pivotally connected to the protruding walls on the corresponding sides of the top panel, the two side panels each rotates into either a standing form or lying form with the pivot of the pivot connection as an axis, and the drawer is inserted in between the side panels in order to hide into the shell;

wherein the top panel comprises at least two downward-protruding, front-to-back-extending positioning plates located on the bottom edges of the two protruding walls of the top panel;

wherein each of the two side panels has a front-to-back-extending long groove for connecting to the positioning plates, each long groove has an opening at a rear of each long groove, the two side panels rotate outwards into the standing form for allowing the positioning plates to align with the openings of the corresponding long grooves, the two standing side panels slide backwards against the top panel for allowing each positioning plate to slide into their corresponding long grooves and locks the two side panels into the standing forms; and wherein the inner edges of the bottom edges of the two protruding walls of the top panel are in a curved shape.

* * * * *